US007594348B2

(12) United States Patent
Oosterlinck

(10) Patent No.: US 7,594,348 B2
(45) Date of Patent: Sep. 29, 2009

(54) SECURITY LABEL

(75) Inventor: Marc F. Oosterlinck, Upland, CA (US)

(73) Assignee: CCL Label, Inc., Upland, CA (US)

( * ) Notice: Subject to any disclaimer, the term of this patent is extended or adjusted under 35 U.S.C. 154(b) by 0 days.

(21) Appl. No.: 11/419,377

(22) Filed: May 19, 2006

(65) Prior Publication Data

US 2008/0040956 A1 Feb. 21, 2008

(51) Int. Cl.
*G09F 3/00* (2006.01)

(52) U.S. Cl. ..... 40/310; 40/633; 428/434; 229/102

(58) Field of Classification Search ..... 40/310, 40/633; 229/102; 428/343, 355 RA
See application file for complete search history.

(56) References Cited

U.S. PATENT DOCUMENTS 4,612,721 A 9/1986 Fumei
4,658,974 A * 4/1987 Fujita et al. ..... 215/12.2
5,135,262 A * 8/1992 Smith et al. ..... 283/94
5,342,093 A * 8/1994 Weernink ..... 283/81
5,799,426 A * 9/1998 Peterson ..... 40/633
6,237,269 B1 * 5/2001 Key ..... 40/638
6,360,462 B1 * 3/2002 Mengel ..... 40/310
6,485,803 B1 * 11/2002 Bright ..... 428/35.1
6,581,972 B2 * 6/2003 Nojima et al. ..... 283/81
6,581,973 B2 * 6/2003 Levine et al. ..... 283/81
7,087,298 B2 * 8/2006 Key ..... 428/343
7,172,668 B2 * 2/2007 Key ..... 156/86

* cited by examiner

*Primary Examiner*—Lesley D. Morris
*Assistant Examiner*—Shin Kim
(74) *Attorney, Agent, or Firm*—Warner Norcross & Judd LLP

(57) ABSTRACT

A tamper-indicating label to be applied to a container. The label is longer than the circumference of the container, so that the label can be wrapped around the container and adhered to itself in an overlap area. The label includes a tamper-indicating mechanism in the overlap area irreversibly indicating if the label has been separated in the overlap area after initial application of the label to the container. The mechanism may be (1) an adhesive bond in the overlap area that is stronger than the label stock in the overlap area, (2) a line of weakening in the label, and/or (3) a frangible material, an adhesive, and/or printing that fractures and/or separates when the overlap area is opened.

8 Claims, 1 Drawing Sheet

SECURITY LABEL

BACKGROUND OF THE INVENTION

The present invention relates to security labels, and more particularly to security labels particularly adapted for pharmaceutical containers to provide an irreversible indication of tampering.

Pharmaceutical label counterfeiting is becoming an increasingly frequent and dangerous problem. In one form of counterfeiting, the labels are removed from discarded authentic containers; and then the labels are reapplied to non-authentic containers containing a replica or other fake of the original product. While this problem is of particular concern to the pharmaceutical industry, this problem confronts a variety of other industries.

To address this counterfeiting problem, prior art labels have been developed that cannot be removed from the original container without breaking the label into many small pieces, or that leave portions of the label, adhesive, or ink behind on the bottle as an indication of tampering. Although these labels address the above-noted counterfeiting issue, they create another problem for the manufacturer during manufacture. Specifically, it sometimes is necessary for a manufacturer to remove and replace a label before shipment if the label has been applied incorrectly or if the label is found to contain incorrect information. Unfortunately, the destructible label makes removal difficult and expensive, and in some cases may damage the container rendering it unsuitable for sale.

Therefore, prior art labels either are susceptible to counterfeiting or create manufacturing difficulties.

SUMMARY OF THE INVENTION

The aforementioned problems are overcome in the present invention in which a security label can be easily removed from a container, and that provides an irreversible indication of removal or other tampering so that the label cannot be reused.

In the disclosed embodiment, the present invention is a label having a length greater than the circumference of the container to which it will be applied. Consequently, the label completely encircles the container and overlaps itself. In the area of overlap, a mechanism for providing an irreversible visible indication of tampering is included.

The mechanism may take a variety of forms. In the disclosed embodiment, the tamper indicating mechanism is an adhesive between the overlapping portions that provides a bond stronger than the label ply. Consequently, the label stock must be destroyed or permanently deformed in order to remove the label from the container. Consequently, the label cannot be reused, for example in a counterfeiting operation. In alternative embodiments, the tamper indicating mechanism can be a frangible material, an adhesive, and/or printing that fractures and/or separates onto the opposite label plies if the overlap area is separated.

The present invention provides a label that may be removed from a container when appropriate, for example during manufacture when the label has been inappropriately applied or contains incorrect information. However, once removed, the label provides an irreversible indication of tampering so that the label cannot be reused inappropriately.

These and other objects, advantages, and features of the invention will be more fully understood and appreciated by reference to the description of the current embodiment and the drawings.

DESCRIPTION OF THE CURRENT EMBODIMENT

Figure 1:
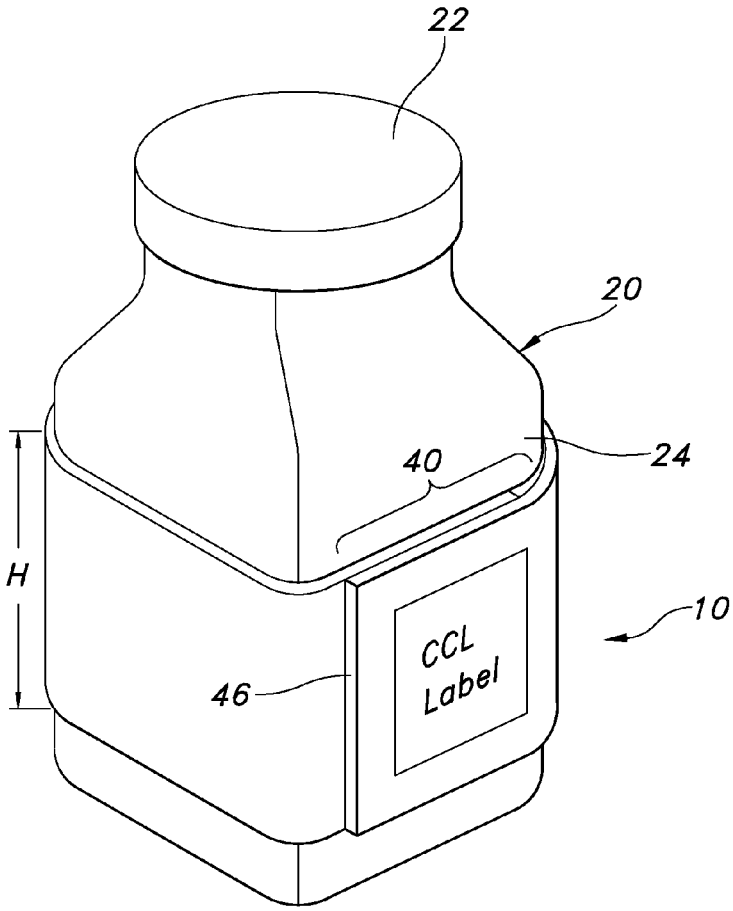
FIG. 1 is a perspective view of a container labeled with the new security label.

A security label constructed in accordance with a current embodiment of the present invention is illustrated in the drawings and generally designated 10.

The label is applied to a container 20, which can be of any conventional design. The disclosed container 20 includes a cap 22 for sealing an open end of the container (not visible under the cap). The container also includes a sidewall 24 extending about and defining the periphery of the container. The sidewall 24 has a circumference, which is the distance around the sidewall. Although the word "circumference" is sometimes associated with a circular configuration, in the present application the word is used to refer to the distance around any closed configuration such as the square cross section (illustrated in the drawings), a circle, a triangle, an oval, or any other shape.

The current embodiment is described in conjunction with a pharmaceutical container. However, the present invention is readily extendable to containers in a wide variety of fields, and therefore is not limited to the pharmaceutical field or any other particular field.

The label 10 includes a single ply or film 32 having an adhesive 34 on its underside facing the container 20. Alternatively, the label may have two or more plies or other constructions. In the current embodiment, the label ply 32 is fabricated of biaxially oriented polypropylene (BOPP). However, a wide variety of materials well known to those skilled in the art may be used depending upon the particular application and requirements.

The label 10 has a height H on the container 20 (FIG. 1). In the current embodiment, the height of the label is less than the height of the sidewall 24. In alternative embodiments, it is possible that the label would be the same height as the sidewall 24, or even conceivably greater than the sidewall if the marginal portions of the label were wrapped around the neck and/or bottom of the container.

Figure 2:
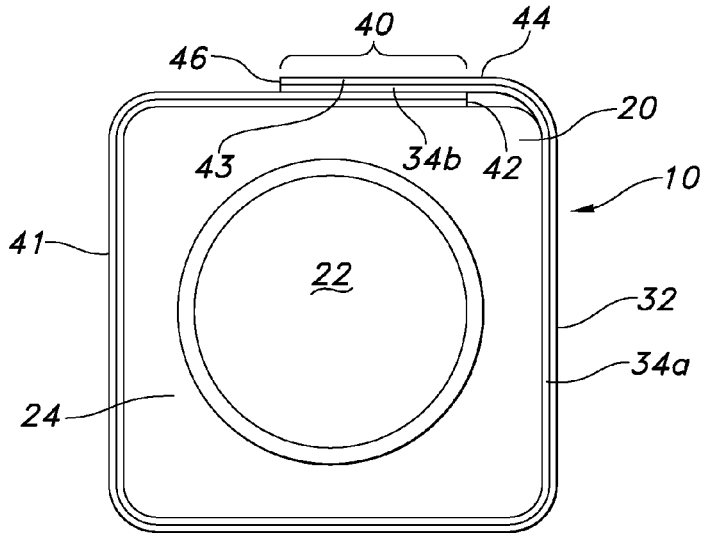
FIG. 2 is a top plan view of the labeled container.

The label 10 has a length greater than the circumference of the sidewall 24. Consequently, when wrapped around the container 20, the label 10 overlaps in the overlap area 40, also referred to as the destruction zone. Consequently, the label 10 has a container portion 41 extending from the leading edge 42 to the line 44 and an overlap portion 43 extending from the line 44 to the trailing edge 46. As can be seen in FIGS. 1 and 2, the container portion engages the container; and the overlap portion 43 overlies the container portion 41 in the overlap area 40.

The adhesive 34 includes a container zone 34*a* and an overlap zone 34*b*. In the preferred embodiment, the adhesive 34 is the same adhesive throughout both zones. Alternatively, different adhesives and techniques can be used to vary the adhesive bonding strength in the two zones. For example, pattern printing may be used (both with a single adhesive and with multiple adhesives) to provide the two zones with different adhesive qualities. It is preferred that the adhesive zone 34*a* enable the label 10 to be peelable or otherwise releasable from the container 20. It is further preferred that the adhesive zone 34*b* provide a permanent interconnection between the overlapping label plies in the overlap zone 40.

As described, the overlap zone 40 provides an area of destruction which provides an irreversible visible indication of tampering if the label is removed from the container 20. More specifically, the adhesive zone 34*b* provides a bond stronger than the label ply 32. Consequently, if the overlap portion 43 is separated from the container portion 41, the label ply 32 is permanently torn, stretched, or otherwise deformed to provide the irreversible indication.

Alternative/supplementary methods of providing the indication of tampering may be used. For example, a line of weakening, such as a perforation, could be formed in the label 10. Also, a frangible material (e.g. a destructible vinyl), an adhesive, and/or printing (e.g. ink over silicon) could be included between the two plies which fractures and/or separates onto the two plies if the plies are separated.

In one embodiment, the label 10 is transparent. When such a label is applied to a transparent container 10, the contents of the container can be viewed through the label and the container.

The labels 10 are manufactured using well known techniques to be carried by a release liner, which preferably is a continuous web with a multiplicity of labels located there along. Alternatively, the release liner can be a sheet with a fixed number of labels on each liner.

During packaging of the products within the containers 20, a label 10 is applied to each container 20. More specifically, the label 10 is dispensed from the release liner and wrapped around the container 20 beginning with the leading edge 42 of the label. As the label is wound around the container 20, the container portion 41 of the label completely encircles and adheres to the sidewall 24. Then the overlap portion 43 of the label 10 overlaps and adheres to the container portion 41 of the label.

If the label 10 is incorrectly applied (for example misaligned or wrinkled) or if the label contains incorrect information, then the label is removed from the container 20 and replaced with another label. When the label 10 is removed, it is permanently deformed in the destruction zone 40 to provide an irreversible indication of tampering. However, the label 10 may be cleanly removed from the container because the combination of the label film 32 and the adhesive zone 34*a* enable the label to be peeled or otherwise cleanly removed from the container.

After the labeled container 20 has been released by the manufacturer, any subsequent removal of the label 10, or even tampering with the label 10 will create a permanent indication in the overlap zone 40. Consequently, the label 10 cannot be removed from the container 20 and reapplied to a different container, for example as might be attempted in a counterfeiting operation.

The present invention therefore provides a simple, inexpensive, and efficient solution to the issue of counterfeit labels, particularly in (but not limited to) the pharmaceutical industry. The labels can be easily removed and replaced during manufacture as necessary. However, the labels cannot be removed and reused after the container has been released by the manufacturer.

The above description is that of the current embodiment of the invention. Various alterations and changes can be made without departing from the spirit and broader aspects of the invention as defined in the appended claims, which are to be interpreted in accordance with the principles of patent law including the doctrine of equivalents.

The embodiments of the invention in which an exclusive property or privilege is claimed are defined as follows:

1. A labeled container comprising:

a container having a sidewall with a circumference;

a label wrapped about said sidewall, said label having a front surface and a back surface and a length greater than said circumference, said label having a container portion and an overlap portion along said length, said container portion and said overlap portion abutting one another, said overlap portion overlapping said container portion; and a single pressure-sensitive adhesive on and extending substantially the full length of said back surface of said label continuously through said container portion and said overlap portion, said adhesive releasably adhering said container portion to said sidewall, said adhesive adhering said overlap portion to said container portion and providing a bond stronger than said label thereby creating a tamper indicating means for indicating whether said overlap portion has been separated from said container portion after said label has been applied to said container.

2. A labeled container as defined in claim 1 wherein said tamper indicating means further includes at least one of a frangible material and printing between said overlap portion and said container portion and adapted to at least one of fracture and separate onto both of said portions when said portions are separated.

3. A tamper revealing label comprising:

a label having a container portion and an overlap portion adapted to overlie and adhere to said container portion when said label is wrapped about a container; and a single pressure-sensitive adhesive including a first adhesive zone on said container portion adapted to releasably adhere said container portion to the container and a second adhesive zone between said overlap portion and said container portion adapted to permanently adhere said overlap portion to said container portion when said label is wrapped about the container, said adhesive extending substantially the full length of said label and being continuous through said first and second adhesive zones, the bond provided by said adhesive being stronger than said label, whereby said label is at least one of deformed and destroyed when said overlap portion is separated from said container portion to provide an irreversible indication of the separation of said overlap portion from said container portion.

4. A tamper revealing label as defined in claim 3 wherein said label further includes at least one of a frangible material and printing that at least one of fractures and separates onto the two portions when the overlap portion is separated from the container portion.

5. A method of producing a container with tamper-revealing labeling comprising the steps of:

providing a label having a front surface and a back surface, said label having a single pressure-sensitive adhesive on said back surface and having a length greater than the circumference of the container, the adhesive extending substantially the full length of the label;

wrapping the label around the container overlapping itself, thereby creating an overlap area, the adhesive extending continuously through said overlap area and the remainder of the label; and releasably adhering the label to the container as the label is wrapped around the container and permanently adhering the label to itself in the overlap area, said permanently adhering step including providing a tamper indication mechanism in the overlap area, whereby the label irreversibly indicates whether the label has been separated in the overlap area after the label has been applied to container.

6. A method as defined in claim 5 wherein the tamper indication mechanism is adapted to cause the label to be deformed when the label is separated in the overlap area.

7. A method as defined in claim 6 wherein the adhesive in the overlap area is stronger than the label, thereby creating the tamper indication mechanism.

8. A method as defined in claim 5 wherein the tamper indication mechanism includes at least one of a frangible material and printing that at least one of fractures and separates onto the two label portions when the label is separated in the overlap area.

* * * * *